United States Patent [19]

Manley

[11] 4,444,538

[45] Apr. 24, 1984

[54] AUTOMATIC LOG FEEDER

[76] Inventor: Jerry Manley, 1820 Ohio St., Chesapeake, Va. 23324

[21] Appl. No.: 397,408

[22] Filed: Jul. 12, 1982

[51] Int. Cl.[3] ..... F23K 3/00

[52] U.S. Cl. ..... 414/176; 110/101 C; 110/108; 110/110; 110/293; 126/124; 414/196; 414/198

[58] Field of Search ..... 110/101 R, 101 C, 101 CF, 110/108, 109, 110, 116, 118, 286, 293; 126/68, 73, 124; 414/176, 196, 198

[56] References Cited

U.S. PATENT DOCUMENTS

| | | | |
|---|---|---|---|
| 591,752 | 10/1897 | Fisher | 110/116 |
| 742,198 | 10/1903 | Josten | 126/73 |
| 789,849 | 5/1905 | Gardner | 110/116 |
| 1,335,265 | 3/1920 | Zamernik | 110/117 |
| 2,454,400 | 11/1948 | Norman | 110/293 |
| 2,773,629 | 12/1956 | Miller | 110/293 |
| 3,232,254 | 2/1966 | Rivers | 110/101 R |
| 3,888,231 | 6/1975 | Galluzzo et al. | 126/120 |
| 4,126,119 | 11/1978 | Fike | 126/124 |
| 4,185,567 | 1/1980 | Grossniklaus | 110/101 R |
| 4,307,700 | 12/1981 | Michael | 126/68 |
| 4,339,998 | 7/1982 | Finch | 110/101 CC |

FOREIGN PATENT DOCUMENTS

| | | | |
|---|---|---|---|
| 2444892 | 7/1980 | France . | |
| 56-157705 | 12/1981 | Japan | 110/108 |

*Primary Examiner*—Edward G. Favors
*Assistant Examiner*—Steven E. Warner
*Attorney, Agent, or Firm*—Sandler & Greenblum

[57] ABSTRACT

An automatic log feeder is provided which includes a hopper for retaining a plurality of logs. The hopper includes a plurality of generally parallel and vertically arranged compartments which are adapted to each hold a single row of logs. The hopper has a chute at its lowermost portion for dispensing individual logs onto a generally vertically arranged conveyor. The vertically arranged conveyor comprises an endless chain driven by a motor and a plurality of sprocket wheels, and a plurality of pairs of brackets which are foldably connected to the chain. Each of the bracket pairs is adapted to receive a single log from the chute. Additionally, the generally horizontally arranged conveyor is positioned beneath the generally vertically arranged conveyor and is adapted to transfer logs to a wood burning apparatus. The generally horizontally arranged conveyor comprises a motor driven push log for moving the logs in a horizontal fashion. The horizontally arranged conveyor also includes a conduit for guiding the logs through a hingedly connected flap on a side wall of the wood burning apparatus.

6 Claims, 5 Drawing Figures

AUTOMATIC LOG FEEDER

FIELD OF THE INVENTION

The present invention generally relates to automatic log feeders, and more particularly to automatic log feeders which are adapted to supply a fireplace or other wood burning apparatus with logs at predetermined intervals.

DISCUSSION OF PRIOR ART

A variety of devices are known for feeding logs or other solid fuel to a burner or fireplace.

ZAMERNICK, U.S. Pat. No. 1,335,265, discloses an automatic fuel feeder for wood burning stoves which has a fuel magazine comprising an upwardly and rearwardly inclined wall and a plurality of pawls which are adapted to support logs or other solid wood blocks. A roller is provided with arms and a handle is moved rearwardly to rotate a shaft and withdraw the pawls from beneath the lowermost block so that it will descend along the teeth of a roller. The roller rotates under the influence of the weight of the block, and the block is thus deposited upon the rear edge of the cover of the furnace so that each block will fall into the stove and rest upon a grate bar.

GROSSNIKLAUS, U.S. Pat. No. 4,185,567, discloses a wood fired furnace assembly which has a device for feeding wood to the furnace. The device comprises a ram aligned with a feed duct, which in turn leads to a fire chamber. A flap is provided to push any wood lying against a wall towards an aperture so that the ram plunger will contact and break up the wood in front of the aperture, thus pushing the wood into the feed duct. The feed duct, in turn, conducts wood in the direction of the fire chamber.

FIKE, U.S. Pat. No. 4,126,119, discloses a fireplace having an arrangement for feeding long logs, at least two at a time, to a combustion chamber. A long tunnel or enclosure having a plurality of walls includes a mouth which is framed by a side wall opening of the firebox. An exterior door opens to the log enclosure and a feed assembly which is provided with log drive rollers which assist in feeding logs to the chamber. Additionally, a coal supply enclosure can be provided which includes a hopper having an inclined bottom wall for delivering coal to the upper surface of a chain belt. The chain belt comprises an endless conveyor driven by a motor.

GALLUZZO et al., U.S. Pat. No. 3,888,231, discloses a fireplce structure having a telescoping feed assembly and a fuel hopper assembly comprising a storage container filled with fuel to be dispensed through a loading door; the fuel is used is preferably coal. The container opens at its lower end through an opening, which in turn communicates the container with a removable chute. The chute is shaped substantially in the form of a rectangular box and extends into a fire chamber via a rack, where it is fitted with a fire proof tap along its inner end.

MONZEIN, French Pat. No. 2,444,892, discloses a fireplace log feeder which is moved by a plurality of wheels. The feeder includes a timer which activates a motor to drive a conveyor and periodically, at timed intervals, deposit logs in a fireplace chamber.

NORMAN, U.S. Pat. No. 2,454,400, discloses an automatic log stroker for furnaces which comprises a hopper and a spring loaded pusher for feeding logs into an arcuate fire box. The arcuate fire box conducts the logs to a rotary grate.

MICHEAL, U.S. Pat. No. 4,307,700, discloses a device for automatically charging a wood burning stove with logs. The device includes a rod-like member and arcuately-shaped log supporting members. A time relay is provided for releasing latching means to allow the log, supporting members to pivot downwardly, and to drop desired logs onto the fireplace.

JOSTEN, U.S. Pat. No. 742,198, discloses a furnace with an automatic sold fuel feeding device. The back of the stove includes a pivotable fire door or valve, which pivots into the stove when solid fuel is delivered to the device from a solid fuel containing slidable receptacle or magazine. The magazine is comprised of a series of superimposed inclined pockets or compartments. A grate is provided for retaining the solid fuel delivered by the feeding device.

FISHER, U.S. Pat. No. 591,752, discloses an apparatus for feeding solid fuel to a furnace which incorporates an operating rod and a hinged door adjacent to a furnace opening.

GARDNER, U.S. Pat. No. 789,849, discloses a coal feeder for a furnace which includes an endless conveyor belt in the form of an elevator having a plurality of buckets attached to it for carrying coal from a supply feed hopper to a charge hopper.

None of these patents disclose the particular delivery apparatus which is incorporated within the present invention, i.e., none discloses a generally vertically arranged first conveying means and a generally horizontally arranged second conveying means.

OBJECTS OF THE INVENTION

It is, accordingly, a general object of the present invention to provide a new and improved automatic log feeder which is capable of automatically feeding a plurality of logs to a fireplace or other wood burning apparatus.

It is an additional object of the present invention to provide a new and improved automatic fireplace feeder which is periodically capable, at timed intervals, of feeding logs to a wood burning apparatus.

Still another object of the present invention is to provide a new and improved automatic log feeder which eliminates the necessity of individually carrying and loading a fireplace with logs, thus increasing the safety and efficiency of the firewood loading operation.

Yet another object of the present invention is to provide a new and improved automatic log feeder which can feed a plurality of logs from the exterior of a building into a fireplace or other wood burning apparatus with increased cleanliness.

The present invention is provided for in a first aspect thereof by an automatic log feeder which comprises means for retaining a plurality of logs to be fed to a wood burning apparatus. The apparatus also includes first conveying means for conducting logs in a generally vertical direction from the retaining means to second conveying means. The second conveying means are adapted to conduct the logs in a substantially horizontal direction to the wood burning apparatus.

The present invention is provided for in a second aspect thereof by an automatic log feeder which comprises a hopper for retaining a plurality of logs. The hopper includes a plurality of generally parallel, vertically arranged compartments which are each adapted to hold a single row of logs. The hopper has a mouth or chute at its lowermost portion for dispensing individual logs. A generally vertically arranged conveyor is provided for receiving logs from the hopper; the conveyor comprises an endless chain driven by a motor, a plurality of sprocket wheels, and a plurality of bracket pairs which are foldably connected to the chain. Each of the bracket pairs is adapted to receive a log from the mouth of the hopper. The apparatus also includes a generally horizontally arranged conveyor which is adapted to transfer logs to the wood burning apparatus in a generally horizontal direction. This horizontally arranged conveyor comprises motor-driven means for moving the logs in horizontal fashion and a conduit for guiding logs into an entrance opening of the wood burning apparatus. The conduit comprises at least one hingedly attached flap.

Upon further study of the specification, drawings, and appended claims, additional objects, features, and advantages of the present invention will become more fully apparent to those skilled in the art to which this invention pertains.

Yet a further object of the invention is to provide a new and improved automatic log feeder which eliminates labor and strain by automatically feeding logs to a wood burning apparatus, saves time in loading the apparatus and in starting fires, and is safe in that it eliminates the necessity of periodically opening a wood burning apparatus.

Yet an additional object of the invention is to provide a new and improved automatic log feeder which minimizes the amount of wood which must be burned in a wood burning apparatus because it periodically feeds wood to the apparatus in an efficient, timed pattern.

BRIEF DESCRIPTION OF THE DRAWINGS

The above and other objects, features and advantages of the present invention will become more apparent to those of ordinary skill in the art to which this invention pertains, from the following detailed description, when considered in connection with the accompanying drawings, in which like reference characters designate like or corresponding parts throughout the several views, and wherein.

DETAILED DESCRIPTION OF THE DRAWINGS

Figures 1, 2, 3, 4, 5:
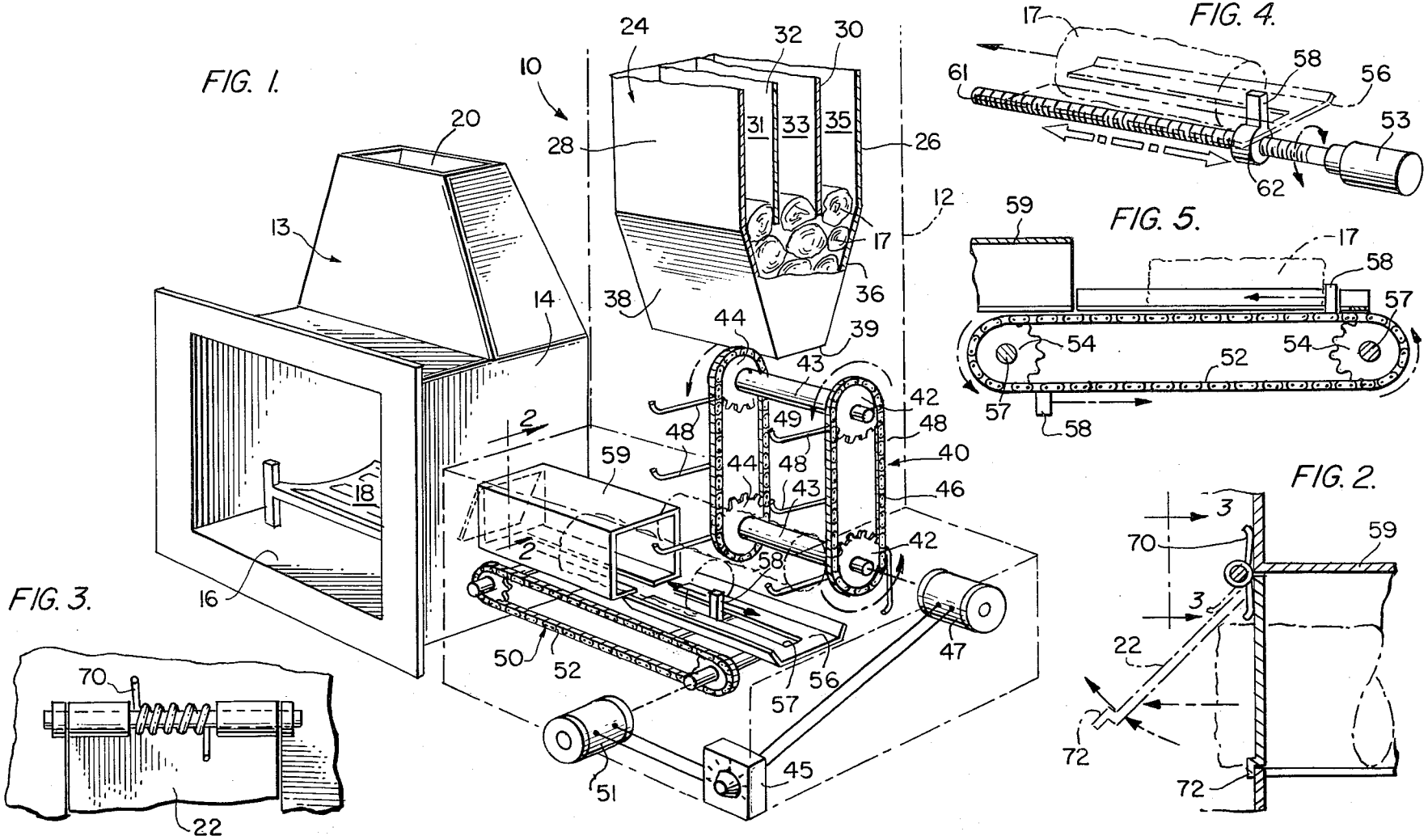
FIG. 1 is a perspective view of the automatic log feeding apparatus of the present invention.
FIG. 2 is a sectional view of part of the horizontal portion of the log feeding apparatus, taken along line 2—2 of FIG. 1.
FIG. 3 is a sectional view of the spring-biased hinged door, taken along line 3—3 of FIG. 2.
FIG. 4 is a perspective view of the horizontal log driving apparatus of FIG. 1.
FIG. 5 illustrates an alternative horizontal log driving apparatus.

With specific reference to FIG. 1, an automatic log feeding apparatus 10 is illustrated, which is held within casing 12 (shown in dotted lines). For purposes of illustration, the feeder is shown as supplying a fireplace 13 with logs to be burned. The present invention is not limited to fireplaces, however, and can be equally applicable with respect to any wood burning apparatus. As illustrated, the fireplace includes a bottom wall 16, a chimney portion 20, and an exterior side wall 14. The exterior side wall can be, e.g., coextensive with the exterior wall of a building, and can incorporate a door 22, which is hinged to wall 14 and which covers an entrance opening to the fireplace. This hinged door is discussed in greater detail hereinafter with respect to FIG. 2 and FIG. 3. This entrance opening is attached to horizontal conveyor means 50, as also explained in greater detail hereinafter. A fireplace grate 18 is positioned on floor 16 of the fireplace to receive logs to be burned at predetermined intervals.

The first major component of the automatic fireplace feeder comprises hopper 24. As illustrated, the hopper includes opposed side walls 26 and 28 arranged in substantially parallel relation, and inclined lower walls 36 and 38, which terminate at a dispensing mouth or chute 39. The dispensing opening is narrow enough to permit only one of logs 17 to be dispensed through the bottom of the apparatus onto vertical conveyor means 40, as explained in greater detail hereinafter. The hopper can include any number of substantially parallel, vertically arranged chambers; in the present drawing, chambers 31, 33 and 35 are defined by inner walls 30 and 32, together with side walls 26 and 28. Each of the interior chambers holds a single row of logs which are gravity fed toward chute or dispensing opening 39 at the bottom of the hopper. The top of the hopper can include an entry opening (not shown), which is preferably of a size only large enough to admit the largest possible log which would fit through the opening in side wall 14 of the fireplace via hinged door or gate 22.

The hopper can be made of a size sufficient to receive any predetermined number of logs; obviously, the greater the number of logs which can be placed into the hopper, the less need there is for the user to go to the exterior of the building in which the wood burning apparatus is located. The hopper is located on the exterior of the building in order to minimize the introduction of dirt into the building in which the wood burning apparatus is located, as the logs will travel directly from the hopper, via the vertical (first) and horizontal (second) conveying means, to the fireplace grate, without traversing the inside of the building. Hopper 24, first conveying means 40, and second conveying means 50 are enclosed in casing 12 to protect the entire apparatus from the weather, animals, and other potential hazards.

Although not illustrated, the chute or mouth can be provided with any conventional metered dispensing device, e.g., slidable gate, in order to insure that only individual logs are dispensed onto vertical conveying apparatus 40 at any one time. Such metering equipment could be connected to timer 45, and thus coordinated with the operation of the first and second conveying apparatus.

The logs which exit hopper chute 39 are then conveyed in a substantially vertical fashion by first conveying means 40. Vertical conveying means 40, as illustrated, includes a pair of endless chains 46 positioned about a plurality (i.e., four) of sprocket wheels 42 and 44, respectively. These wheels are positioned at the ends of rotatable shafts 43. The endless chains are driven, via the shafts and the sprocket wheels, by an electric motor 47. The electric motor is periodically energized by a timer 45, which can be set to energize the motor at predetermined intervals, e.g., every thirty minutes or one hour. In this fashion, individual logs can be delivered to the wood burning apparatus 14 at predetermined intervals via the vertical and horizontal conveyors, in order to most efficiently utilize the wood and to generate heat to the interior of a building. Foldable brackets 48, which are pivotable to endless chains 46 and 49, are provided for carrying individual logs vertically downwardly. Each pair of brackets 48 retains one log, as illustrated in FIG. 1, and after delivering the log to second conveyor means 50, and the brackets are adapted to fold upwardly, in a fashion parallel and adjacent to the endless chains 46; (this is the position of the brackets when they are not adapted to carry logs). In one preferred embodiment, the brackets are spring biased upwardly against the chains and are only arranged in a substantially perpendicular fashion to the chains when under the weight of individual logs 17. Alternatively, each hopper compartment can be provided with a separate vertical conveying structure 40 to supply individual logs to the horizontal conveying structure.

The first conveying means 40 is adapted to vertically deliver individual logs to horizontal conveying means 50. The horizontal conveying means, as illustrated in FIG. 1, comprises a track or guideway 56 along which logs 17 are adapted to move. Track 56 is provided with a central slot 57, along which push lug 58 can be slideably driven. The push lug is attached, e.g., to an endless chain 52, which is adapted to be driven by reversible motor 51, via sprocket wheels 54, shafts 53 and the endless chain. In this fashion, when a log is placed on the guide, the motor is energized, and the push lug will serve to drive a single log 17 towards wood burning apparatus side wall 14. Part of the guide track is provided with a tubular conduit 59, as illustrated in FIG. 1, in which the log is received and guided. The outer part of the tubular conduit may be provided with a hinged flap (not shown) which is similar to hinged flap 22 of the wood burning apparatus. Although the dimensions of the hinged flap are not critical, one preferred embodiment of the present device incorporates a 6 inch by 6 inch tubular conduit and a slightly smaller hinged flap; the entry aperture and hinged flap 22 of the wood burning apparatus are similarly sized. In this fashion, only logs of desired sizes will be admitted into the fireplace; again, it is noted that the entry opening (not shown) of hopper 24 is also similarly sized. Motor 51 is connected to timer 45, as was motor 47, and is energized by the timer at the same time as motor 47. In this fashion, both of the conveyors will be operable at the same time so as to deliver one or more pieces of wood in a timely fashion to the wood burning apparatus.

FIGS. 4 and 5 best illustrate two embodiments of lug driving apparatus which form part of the horizontal conveyor. FIG. 5 illustrates the device illustrated in FIG. 1, which includes push lugs 58 attached to endless chain 52. The chains are driven by sprocket wheels 54 and shafts 57, one of which is attached to reversible motor 51. Alternately, an endless screw conveyor could be used to direct the log, or a jack screw and nut arrangement, as seen in FIG. 4. Reversible motor 53 here drives jack screw 61; the rotation of the jack screw, in turn, rotates drive push lug 58, attached to the screw by jack nut 62. The push lug can therefore be moved in either recriprocal direction.

It is possible to place a latching device, as shown in FIG. 3, on either of the hinged doors or gates. This latching can comprise, e.g., a spring 70 whose biasing force maintains the door 22 in closed position. The gate is provided with stop 72, in order to prevent the door from swinging outwardly into tube 59, as seen in FIG. 2. The automatic log feeder is simple in operation and easy to use. The user simply sets the timer 45, which will generally be either located within the assembly 10 or in a house, in order to periodically deliver a plurality of logs, at timed intervals, from hopper 24 to the wood burning apparatus. This method of operation presupposes that the user has already loaded the hopper with logs to be burned. When the timer is set for a predetermined time interval, upon occurrence of such intervals, motors 47 and 51 will be activated. At that time, both vertical conveyor means 40 and horizontal conveyor means 50 will be placed in operative condition; the second motor could alternately be later energized so as to not begin the driving the push lug 58 until the log is placed on the guide 56. This can be controlled by providing for a delay between the time in which the motors are energized. As conveyor 40 begins to move, a new pair of brackets 48 will be positioned under hopper chute 39 in order to receive the lowermost log in the hopper. Once loaded with a log, each pair of brackets on one side of conveyor 40 will be perpendicular in position with respect to chains 46, and will have one log retained thereon; the lowermost pair of brackets, which are inclined slightly downwardly, will deliver one log 17 to horizontal conveyor means 50. Each time that the vertical conveyor means 40 is activated, the next pair of folded brackets will receive the lowermost log from chute 39, and the lowermost pair of perpendicular brackets will deliver the next log 17 to second conveyor 50. If desired, chute 39 can be provided with a slidable door activated by the motor (to dispense single logs onto each pair of brackets).

Once a log is delivered to second conveyor means 50, and motor 51 is energized, the push lug serves to force the log along guideway, into conduit 59 through its hinged door, and into wood burning apparatus via hinged gate 22. As the log enters the fireplace it will automatically be positioned in the center of fireplace grate 18. At this time, both motors are shut off by the timer, and are reactivated at a later, predetermined interval. The timer can be set at any desired time interval so that logs will be fed to the fireplace at desired spaced intervals.

If the latching device is placed on either of the hinged gates, as illustrated in FIGS. 2 and 3, movement of the log overcomes the biasing force exerted by the latching device to permit the gates to swing inwardly and upwardly, as illustrated in FIG. 1, and to permit log entry, first into the conduit, and then into the fireplace itself.

By the above operation, a fireplace or other wood burning apparatus is periodically supplied with wood to be burned in a clean, efficient and safe manner which requires little manual labor or supervision.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. An automatic log feeder comprising:

(a) a hopper for retaining a plurality of logs, said hopper having a plurality of generally parallel, vertically arranged compartments separated by a plurality of dividers, each compartment comprising means for holding a single row of individual logs, said hopper having a log entry opening at an upper portion thereof and having a chute at a lowermost portion thereof for dispensing individual logs;

(b) a first, generally vertically arranged conveyor for receiving logs from said chute and for conducting them downwardly in substantially vertical fashion, said conveyor comprising a pair of endless chains driven by a motor and a plurality of sprocket wheels, and a plurality of pairs of brackets which are foldably connected to said chains, each of said bracket pairs comprising means for retaining only a single log from said chute; and (c) a second, generally horizontally arranged conveyor adapted to transfer individual logs in a generally horizontal direction to a woodburning apparatus, said second conveyor comprising motor-driven means for pushing each log in a horizontal fashion and a conduit for guiding said logs into the entrance of said woodburning apparatus, said conduit comprising at least one hingedly attached entrance door which is adapted to be pivoted upon engagement with a log being fed into said woodburning apparatus.

2. An automatic log feeder in accordance with claim 1 wherein said brackets fold against said chains.

3. An automatic log feeder in accordance with claim 1 wherein said second conveyor means comprises a push lug attached to an endless conveyor driven by a reversible motor and sprocket wheels.

4. An automatic log feeder in accordance with claim 1 wherein said second conveyor comprises a push lug attached to a jack screw rotatably driven by a reversible motor.

5. An automatic log feeder in accordance with either claims 3 and 4 wherein said reversible motors are periodically activated by a timer at predetermined intervals.

6. An automatic log feeder in accordance with claim 5 wherein said second conveyor further comprises an entry conduit for guiding said logs into the wood burning apparatus, said conduit having a first end spaced from said wood burning apparatus and a second end attached to said wood burning apparatus, said wood burning apparatus comprising a hinged door through which logs enter the apparatus from the conduit.

* * * * *

UNITED STATES PATENT AND TRADEMARK OFFICE

CERTIFICATE OF CORRECTION

PATENT NO. : 4,444,538

DATED : April 24, 1984

INVENTOR(S) : Jerry MANLEY

It is certified that error appears in the above-identified patent and that said Letters Patent is hereby corrected as shown below:

In column 1, line 51, delete "fireplce" and substitute ---fireplace---

In column 1, line 54, delete "is" (first occurrence).

In column 2, line 31, delete "discloses" and substitute ---disclose---

In column 6, line 11, before "to" insert ---not---

In column 6, line 11, delete "not" (second occurrence).

In column 6, line 11, delete "the" (first occurrence).

In column 6, line 33, after "along", insert ---the---

Signed and Sealed this

*Sixth* Day of *November 1984*

[SEAL]

*Attest:*

GERALD J. MOSSINGHOFF

*Attesting Officer*

*Commissioner of Patents and Trademarks*